US006242144B1

(12) United States Patent
Lin et al.

(10) Patent No.: US 6,242,144 B1
(45) Date of Patent: Jun. 5, 2001

(54) ELECTROPHOTOGRAPHIC IMAGING MEMBERS

(75) Inventors: Liang-Bih Lin, Webster; Markus R. Silvestri, Fairport; John F. Yanus, Webster; Richard H. Nealey, Penfield; Harold F. Hammond, Webster; Cindy C. Chen, Rochester; Kenny-tuan T. Dinh, Webster; James M. Markovics, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/659,705

(22) Filed: Sep. 11, 2000

(51) Int. Cl.[7] ..... G03G 5/047
(52) U.S. Cl. ..... 430/58.4; 430/58.8
(58) Field of Search ..... 430/58.45, 58.8, 430/83, 95

(56) References Cited

U.S. PATENT DOCUMENTS

| | | | | |
|---|---|---|---|---|
| 4,675,272 | * | 6/1987 | Siskind | 430/62 |
| 4,727,009 | | 2/1988 | Takai | 430/58 |
| 4,787,928 | | 11/1988 | Kan et al. | 430/58 |
| 4,806,443 | | 2/1989 | Yanus et al. | 430/56 |
| 4,806,444 | | 2/1989 | Yanus et al. | 430/56 |
| 4,847,175 | | 7/1989 | Pavlisko et al. | 430/58 |
| 4,889,784 | | 12/1989 | Champ et al. | 430/58 |
| 5,028,502 | | 7/1991 | Yuh et al. | 430/31 |
| 5,164,276 | * | 11/1992 | Robinson et al. | 430/58.35 |
| 5,436,706 | | 7/1995 | Landa et al. | 355/256 |
| 5,468,583 | | 11/1995 | Gruenbaum et al. | 430/58 |
| 5,596,396 | | 1/1997 | Landa et al. | 399/237 |
| 5,677,094 | | 10/1997 | Umeda et al. | 430/58 |
| 5,830,614 | | 11/1998 | Pai et al. | 430/59 |
| 5,834,146 | | 11/1998 | Hoshizaki et al. | 430/59 |
| 6,068,960 | | 5/2000 | Pai et al. | 430/132 |

FOREIGN PATENT DOCUMENTS

| | | |
|---|---|---|
| 5-110485 | 5/1993 | (JP) . |

* cited by examiner

*Primary Examiner*—John Goodrow
(74) *Attorney, Agent, or Firm*—E. D. Palazzo

(57) ABSTRACT

An electrophotographic imaging member including a substrate, a charge generating layer, and a charge transport layer including a hole transport host material, a trace amount of a shallow trap dopant having a shallow trap electrochemical oxidation potential between about 0.02 volt and about 1.5 volts lower than that of the hole transport host and a film forming binder.

17 Claims, 2 Drawing Sheets

ELECTROPHOTOGRAPHIC IMAGING MEMBERS

BACKGROUND OF THE INVENTION

This invention relates in general to electrophotographic imaging members and, more specifically, to electrophotographic imaging members comprising a shallow trap dopant and processes for fabricating the members.

Electrophotographic imaging members (photoreceptors) are well known. Typical electrophotographic imaging members are commonly utilized in electrophotographic (xerographic) processes in either a flexible belt or a rigid drum configuration. These electrophotographic imaging members comprise a photoconductive layer comprising a single layer or composite layers. One type of composite photoconductive layer used in xerography is illustrated in U.S. Pat. No. 4,265,990 which describes a photosensitive member having at least two electrically operative layers. One layer comprises a photoconductive or charge generating layer (CGL) which is capable of photogenerating holes and injecting the photogenerated holes into a contiguous charge transport layer (CTL). Generally, where the two electrically operative layers are supported on a conductive layer, the charge generating layer is sandwiched between a contiguous charge transport layer and the supporting conductive layer. Alternatively, the charge transport layer may be sandwiched between the supporting electrode and a charge generating layer. Photosensitive members having at least two electrically operative layers, as disclosed above, provide excellent electrostatic latent images when charged with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

One problem with prior art photoreceptors relates to photoinduced discharge curve (PIDC) characteristics of the photoreceptors. The expression photoinduced discharged curve (PIDC), as employed herein, is defined as a relationship between the potential as a function of exposure and is a measure of the sensitivity of the device. It generally represents the supply efficiency (number carriers injected from the generator layer into the transport layer per incident photon) as a function of the field across the device. More specifically, when the $V_{low}$, voltage at a high light exposure, is below a predetermined value, the imaging system consumes toner too rapidly, resulting in early failure of the imaging system. This is due to excess deposition of toner in the image areas to form very dense layers. $V_{low}$ is related to $V_{residual}$. The combination of electrical bias and $V_{low}$ results in overtoning during electrostatic latent image development to form toner images that are too dense, i.e., the electrical development field is too large. "$V_{low}$", as employed herein, is defined as the surface potential of a PIDC at a high intensity light exposure of, e.g., about 2.5–15 ergs/cm$^2$. "$V_{residual}$", as employed herein, is defined as the surface potential of a PIDC at a given light exposure (e.g., about 25–300 ergs/cm$^2$), that is significantly higher (e.g., about 10 times) than the exposure leading to $V_{low}$. Cyclic stability is important and $V_{residual}$ and $V_{low}$ can increase with cycling due to persistently trapped charges. $V_{low}$ approaches $V_{residual}$ in an infinite amount of time. Thus, it is desirable to raise $V_{low}$ in a controlled fashion to a desirable value, which can be maintained under repeated use, and preferably without significantly altering the initial and low exposure photosensitivity. In other words, a more tunable photoreceptor is desirable. Tunable photoreceptors, due to their tunable photosensitivity characteristics, have the advantage of being applicable to many different xerographic machines, including printers, copiers, duplicators, facsimile machines, multifunctional machines, and the like. With dual photoconductive components in a charge generating layer, a high sensitivity pigment such as hydroxygallium phthalocyanine and a low sensitivity pigment such as alkylhydroxygallium phthalocyanine, the initial photosensitivity can be adjusted within a range corresponding to the loading ratio of each component. However, it is often difficult to match both high field and low field photoinduced discharge curves ($V_{low}$ PIDC) by merely adjusting the CGL composition. $V_{low}$ is related to charge generation and transport and can be adjusted by photogeneration and charge transport efficiencies. $V_{low}$, is a critical parameter to toner consumption and is difficult to adjust by merely varying the composition of a charge generation layer. For example, a multilayered photoreceptor comprising a charge generating layer of chlorogallium phthalocyanine dispersed in a film forming binder and a charge transport layer comprising an arylamine charge transport material in a film forming binder has a low $V_{low}$, and attempts to raise $V_{low}$ by lowering the photogeneration efficiency by changing the CGL composition is not sufficient because it may also change the initial photosensitivity to some undesirable value.

INFORMATION DISCLOSURE STATEMENT

U.S. Pat. No. 6,068,960 issued to D. Pai et al. on May 30, 2000—A photoreceptor fabrication method including: (a) depositing a charge generating layer; (b) depositing a first charge transport layer having a first charge carrier mobility value; and (c) depositing a second charge transport layer having a second charge carrier mobility value that is different from the first charge carrier mobility value; wherein steps (a), (b), and (c) occur in any order, wherein the difference in the first charge carrier mobility value and the second charge carrier mobility value is accomplished by:

(i) wherein the first charge transport layer includes a first binder and a first charge transport material and the second charge transport layer includes a second binder and a second charge transport material, selecting the first binder to have a lesser solubility limit for the first charge transport material than the solubility limit of the second binder for the second charge transport material; or (ii) wherein the first transport layer includes a first polymeric compound composed of a first charge transport moiety covalently bonded to a first binder moiety and the second transport layer includes a second polymeric compound composed of a second charge transport moiety covalently bonded to a second binder moiety, selecting the proportion of the first charge transport moiety in the first polymeric compound to be less than the proportion of the second charge transport moiety in the second polymeric compound.

CROSS REFERENCE TO COPENDING APPLICATIONS

U.S. patent application Ser. No. 09/152,972, U.S. Pat No. 6,112,7077 entitled "Photoreceptors With Delayed Discharge" filed Sep. 14, 1998, in the names of D. Pai et al.—A photoreceptor is disclosed having a substrate, including: (a) a charge generating layer; (b) a first charge transport layer having a first charge carrier mobility value; and (c) a second charge transport layer having a second charge carrier mobility value, wherein the first charge transport layer is closer to the charge generating layer than the second charge transport layer and the second charge transport layer is contiguous to the first charge transport layer, wherein the second charge carrier mobility value is higher than the first charge carrier mobility value.

The entire disclosures of each of the above cited patents and patent applications are incorporated herein by reference.

While the above mentioned treatment techniques may be suitable for their intended purposes, there continues to be a need for an improved photoreceptor in which $V_{low}$ can be flexibly raised without significant changes to the other parts of PIDC, especially the initial photosensitivity.

BRIEF SUMMARY OF THE INVENTION

It is, therefore, an object of the present invention to provide an improved photoreceptor having a $V_{low}$ that can be flexibly raised to some desirable value without substantially altering the initial and low light exposure photosensitivity.

It is another object of the present invention to provide an improved photoreceptor which uses toner at a lower rate.

It is still another object of the present invention to provide an improved photoreceptor which prevents overtoning during development.

It is yet another object of the present invention to provide an improved photoreceptor which exhibits greater cyclic stability even at relatively high $V_{low}$.

It is another object of the present invention to provide an improved photoreceptor which can be manufactured with greater flexibility in achieving a wide range of different photoelectrical properties, mainly in PIDC.

The foregoing objects and others are accomplished in accordance with this invention by providing an electrophotographic imaging member comprising

- a substrate,
- a charge generating layer, and
- a charge transport layer comprising
  - a hole transport host material,
  - a trace amount of a shallow trap dopant having a shallow trap electrochemical oxidation potential between about 0.02 volt and about 1.5 volts lower than that of the hole transport host, and
  - a film forming binder.

Any suitable hole transporting small molecules and hole transporting polymers may be utilized as the shallow trap dopant so long as the electrochemical oxidation potential thereof is between about 0.02 volt and about 1.5 volts lower than that of the selected hole transport host material. The electrochemical potential values herein are measured in the same organic solvent, such as methylene chloride, and reference electrode such as the standard Saturated Calomel Electrode (SCE). $V_{low}$ can be flexibly raised to a predetermined desired value without substantially altering the initial and low light exposure photosensitivities by more than about 15 percent of their original values. The initial and low light exposure photosensitivities are defined by $(dV/dX)x=o$ being the derivative of surface potential vs. exposure at zero light exposure, and $E_{0.1}$ and $E_{0.2}$ being the amounts of radiation necessary to discharge an electrophotographic imaging member 10 percent and 20 percent, respectively, of the original surface potential on the electrophotographic imaging member.

Electrophotographic imaging members (photoreceptors) are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer and about 0.3 micrometer. Any suitable conventional technique may be utilized for applying and drying an adhesive layer.

The electrophotographic imaging member also comprises multiple active layers including a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group I–VI compounds; and organic pigments such as quinacridones, polycyclic pigments such as dibromo anthanthrone pigments, perylene and perinone diamines such as benzimidazole perylene, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. Removal of the solvent of a solvent coated layer may be effected by any suitable conventional technique such as oven drying, infrared radiation drying, air drying and the like.

The charge transport layer is a single layer. In other words, the charge transport layer in the photoreceptor of this invention consists of only a single charge transport layer. This charge transport layer comprises a hole transporting small molecule, charge transporting polymer, or a mixture of two charge transporting molecules, which is referred to herein as a hole transport host material, dissolved or molecularly dispersed in a film forming electrically inert polymer such as a polycarbonate and a trace amount of a dissolved or molecularly dispersed shallow trap dopant having an electrochemical oxidation potential between about 0.02 volt and about 1.5 volts lower than that of the charge transport host. The electrochemical potential values herein are measured with the same organic solvent, such as methylene chloride, and reference electrode, such as a standard Saturated Calomel Electrode (SCE). Typical known procedures for measuring electrochemical reduction-oxidation potentials can be found in, for example, "Electrochemical Methods: Fundamentals and Applications", ISBN: 0471055425, by Allen J. Bard and Larry R. Faulkner, John Wiley and sons, 1980, the entire disclosure thereof being incorporated herein by reference.

Any suitable hole transporting small molecule or polymer may be utilized as the shallow trap dopant in the charge transport layer of this invention so long as the electrochemical oxidation potential of the shallow trap dopant is between about 0.02 volt and about 1.5 volts lower than that of the selected charge transport host material. Generally, chemical substituents that are electron donating, such as alkyl groups, alkyloxy groups, and the like may be attached to any charge transporting material to lower the electrochemical oxidation potential thereof to a desirable value. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable hole transporting or electrically active small molecule may be employed in the charge transport layer of this invention. The expression hole transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. As indicated above, suitable electrically active small molecule hole transporting compounds are dissolved or molecularly dispersed in electrically inactive polymeric film forming materials. A small molecule hole transporting compound that permits injection of holes from the pigment into the charge generating layer with high efficiency and transports them across the charge transport layer with very short transit times includes arylamines such as N,N'-diphenyl-N,N'-bis(3-methylphenyl)-(1,1'-biphenyl)-4,4'-diamine, enamines, stilbene substituted arylamines, and the like. If desired, hole transporting polymers that permit injection of holes from the pigment into the charge generating layer with high efficiency and transports them across the charge transport layer with very short transit times may be utilized instead of or in addition to the small molecule charge transporting compounds so long as the these polymers provide the requisite oxidation potential difference between the shallow trap dopant and charge transport host. Typical hole transporting polymers include, for example, polymeric arylamine compounds and related polymers described in U.S. Pat. No. 4,801,517, U.S. Pat. No. 4,806,444, U.S. Pat. No. 4,818,650, U.S. Pat. No. 4,806,443 and U.S. Pat. No. 5,030,532. Polyvinylcarbazole and derivatives of Lewis acids described in U.S. Pat. No. 4,302,521. Electrically active polymers also include polysilylenes such as poly(methylphenyl silylene), poly(methylphenyl silylene-co-dimethyl silylene), poly(cyclohexylmethyl silylene), poly(tertiarybutylmethyl silylene), poly(phenylethyl silylene), poly(n-propylmethyl silylene), poly(p-tolylmethyl silylene), poly(cyclotrimethylene silylene), poly (cyclotetramethylene silylene), poly(cyclopentamethylene silylene), poly(di-t-butyl silylene-co-di-methyl silylene), poly(diphenyl silylene-co-phenylmethyl silylene), poly (cyanoethylmethyl silylene) and the like. Vinylaromatic polymers such as polyvinyl anthracene, polyacenaphthylene; formaldehyde condensation products with various aromatics such as condensates of formaldehyde and 3-bromopyrene; 2,4,7-trinitrofluoreoene, and 3,6-dinitro-N-t-butylnaphthalimide as described in U.S. Pat. No. 3,972,717. Other polymeric transport materials include poly-1-vinylpyrene, poly-9-vinylanthracene, poly-9-(4-pentenyl)-carbazole, poly-9-(5-hexyl)-carbazole, polymethylene pyrene, poly-1-(pyrenyl)-butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric transport materials as described in U.S. Pat. No. 3,870,516. The disclosures of each of the patents identified above pertaining to binders having charge transport capabilities are incorporated herein by reference in their entirety.

Any suitable electrically inactive resin binder may be employed in the charge transport layer of this invention. Typical inactive resin binders include polycarbonate resin, polyester, polyarylate, polyacrylate, polyether, polysulfone, and the like. Weight average molecular weights can vary, for example, from about 20,000 to about 150,000. However molecular weights outside of this range may be employed so long as the objectives of this invention are satisfied. Preferred binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), and the like. Any suitable charge transporting polymer may also be utilized in the charge transporting layer of this invention. These electrically active charge transporting polymeric materials should be capable of supporting the injection of photogenerated holes from the charge generation material and be incapable of allowing the transport of these holes therethrough. Hole transporting polymers be used in combination with hole transporting small molecules and/or inert film forming polymer binders. However, hole transporting polymers free of inert film forming polymer binders are preferred. Thus, one active film forming polymer can function as the hole transporting host material and another suitable hole transport molecule or different hole transporting polymer can act as the shallow trap dopant. Thus, depending on the electrochemical oxidation potential of the polymer, a hole transporting polymer can also be used as a shallow trap dopant or as a hole transport host. Moreover, when one active film forming polymer functions as the hole transporting host material and a different hole transporting polymer functions as the shallow trap dopant, one or both of these materials can also perform the functions of a film forming binder.

The charge transport layer of the electrophotographic imaging member of this invention includes a trace amount of the shallow trap dopant. The expression "shallow trap dopant" as employed herein is defined as a charge holding agent which creates shallow energetic traps. More specifically, a shallow trap dopant is an organic compound which has an electrochemical oxidation potential between about 0.02 volt and about 1.5 volts lower than that of the hole transport host material. The shallow trap dopant can be described as an x-volt shallow trap, where x is the difference in electrochemical oxidation potential between the hole transport host and shallow trap dopant. Typical shallow trap dopants include, for example, p-diethylaminobenzalde diphenylhydrazone, N,N',N",N'"-tetrakis (4-methylphenyl)-(1,1'-biphenyl)-4,4'-diamine, N, N',N",N'"-tetrakis(4-methoxyphenyl)-(1,1'-biphenyl)-4,4'-diamine, N,N',bis-(4-methylphenyl)-N,N"-bis(4-ethylphenyl)-1,1'-3,3'-dimethylbiphenyl)-4,4'-diamine, and the like. These materials have electrochemical oxidation potentials that are about 0.1 volt to about 1.2 volts lower than that of a typical hole transport host such as N,N'-diphenyl-N,N'-bis(3-methylphenyl)-(1,1'biphenyl)-4,4'-diamine. The charge transport mobility in the charge transport layer is strongly dependent on shallow trap dopant concentration, only a trace amount of shallow trap dopant is used to reduce charge mobility. This technique is flexible without requiring any substantial alternations in coating conditions and can be applied with ease in any charge transport layer. Generally, the shallow trap dopant is present in the charge transport layer in a trace amount of between about 0.01 percent and about 10 percent by weight, based on total weight of the hole transport host material used in the charge transport layer. Preferably, the trace amount of the shallow trap dopant used in the charge transport layer of this invention is between about 0.1 percent and about 4 percent by weight based on the total weight of the hole transport host used in the charge transport layer. Depending on the trap potential, i.e., the voltage difference in oxidation potentials between the shallow trap dopant and the hole transport host, for example a 0.3 V shallow trap, the concentration of the shallow trap can be from about 0.01 percent to about 10 percent without effectively changing the initial photosensitivity and photosensitivity at low light exposure. The trace amount of shallow trap dopant raises the $V_{low}$ without adversely affecting the initial photosensitivity and photosensitivity at low light exposure. The preferred range for the dopant can vary depending upon the hole transport host and specific shallow trap dopant selected and the specific machine in which the material is used. Preferably, the electrochemical oxidation potential of the shallow trap dopant is between about 0.8 volt and about 1.5 volts lower than that of the hole transport host material when the hole transport layer contains between about 0.1 percent and about 4 percent by weight of the shallow trap dopant based on the total weight of the charge transport layer. When the hole transport layer contains between about 0.5 percent and about 10 percent by weight of the shallow trap dopant based on the total weight of the charge transport layer, it is preferred that the electrochemical oxidation potential of the shallow trap dopant is between about 0.02 volt and about 0.8 volts lower than that of the hole transport host material.

Any suitable and conventional technique may be utilized to mix and thereafter apply the charge transport layer coating mixture to the charge generating layer. Typical application techniques include, for example, spraying, dip coating, roll coating, wire wound rod coating, and the like. Drying of the deposited coating may be effected by any suitable conventional technique such as, for example, oven drying, infra red radiation drying, air drying and the like.

Generally, the thickness of the charge transport layer after drying is between about 10 and about 50 micrometers, but thicknesses outside this range can also be used. The transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the transport layer to the charge generator layers is preferably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

BRIEF DESCRIPTION OF THE DRAWINGS

A more complete understanding of the present invention can be obtained by reference to the accompanying drawings wherein.

Figure 1:
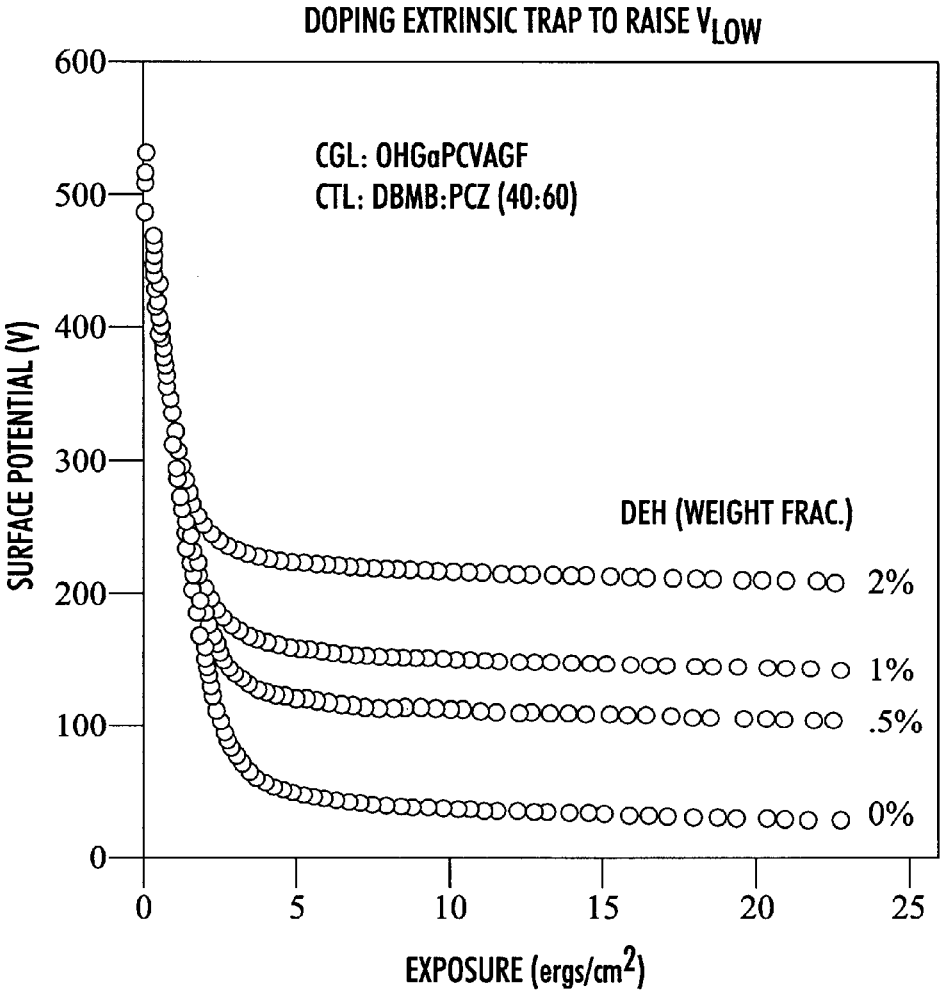
FIG. 1, shows surface potential versus exposure for PIDC curves for four photoreceptor drums doped with 0 to 2 percent weight fractions of a shallow trap dopant in a charge transport layer.

A more detailed description of the drawings are set forth below in the working Examples.

PREFERRED EMBODIMENT OF THE INVENTION

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

Four electrophotographic imaging members were prepared by applying by dip coating a charge blocking layer onto the rough surface of four aluminum drums having a diameter of 30 mm and a length of 34 cm. A zirconium silane blocking layer coating was formed on each drum, the coatings having a thicknesses of 1.3 micrometers after drying. The dried blocking layers were coated with a charge generating layer containing 54 weight percent Type V hydroxy gallium phthalocyanine pigment particles, 46 weight percent VAGF film forming polymer and employing n-butylacetate solvent. 6.8 grams of VAGF film forming polymer (available from Union Carbide) was first dissolved in 119.6 grams of n-butylacetate solvent. After complete dissolution, 8.0 grams of Type V hydroxy gallium phthalocyanine pigment particles were added and ball milled. The resulting mixture of 46 percent by weight VAGF and 54 percent by weight hydroxygallium phthalocyanine, based on the total weight of solids, was then diluted with 149.5 grams of n-butylacetate solvent. The coatings were applied at a coating bath withdrawal rate of 200 millimeters/minute. After drying in a forced air oven, the charge generating layers had thicknesses of about 0.3 micrometer. The four drums were each subsequently coated with different charge transport layers containing the same amounts of a small molecule charge transport molecule in a film forming binder, but containing concentrations of a shallow trap dopant. Thus, each coating composition contained N,N'-diphenyl-N,N'-bis(3-methylphenyl)-1,1;-biphenyl-4,4'-diamine hole transport host and polycarbonate (PCZ400, available from the Mitsubishi Chemical Company) in a weight ratio of 40:60. The concentrations of a 1.2 volt shallow trap dopant p-diethylaminobenzalde diphenylhydrazone, which had an electrochemical potential of 1.2 volts lower than that of N,N'-diphenyl-N,N'-bis(3-methylphenyl)-1,1;-biphenyl-4,4'diamine, in the four different charge transport coating compositions were 0, 0.5, 1 and 2 in weight percentage with respect to N,N'-diphenyl-N,N'-bis(3-methylphenyl)-1,1;biphenyl-4,4'-diamine. The coating mixture also included a 79.2 weight percent mixture of 4 to 1 ratio of THF and MCB solvent. The four solutions showed similar Theological properties with a Newtonian behavior of 300 centipose at nominal shear stresses of 0.1 $S^{-1}$ to 100 $s^{-1}$. The four different coatings were applied to the four drums in Tsukiage dip coating apparatus at a pull rate of 130 mm/min. After drying in a forced air oven for 45 minutes at 120° C., all the transport layers had similar thicknesses of about 21–22 micrometers.

Figure 2:
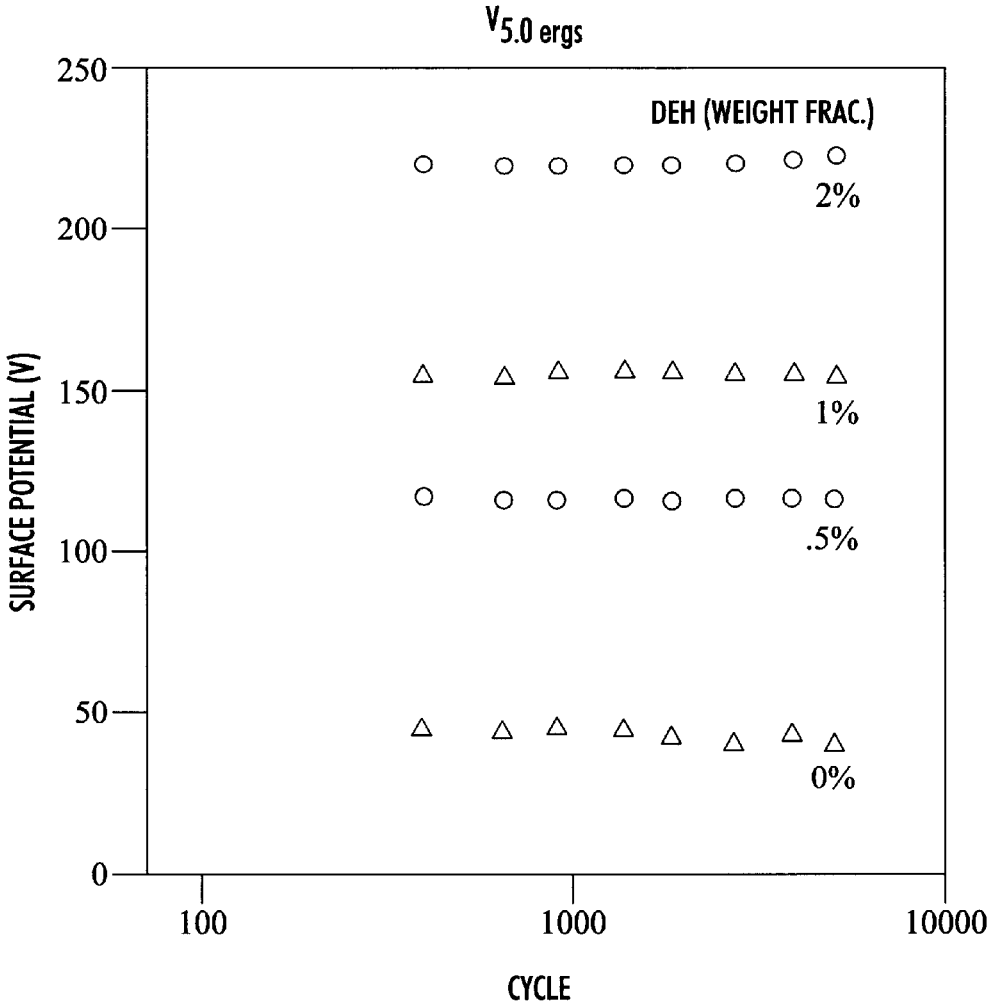
FIG. 2, shows $V_{low}$ versus PIDC cycle from five thousand cycle tests are shown for four drums.

PIDC curves for the four different photoreceptors were obtained by electrically testing with a cyclic scanner set at a speed of 61 rpm and an exposure light wavelength of 780 nm, wherein the light intensity was incrementally increased with cycling to produce a photoinduced discharge curve from which the photosensitivity was measured. The scanner was equipped with a scrorotron charger set to a surface potential of about 540 volts. The entire xerographic simulation was carried out in an environmentally controlled light tight chamber at ambient conditions. (50 percent RH and 20° C.). These PIDC curves for the four photoreceptors with different concentrations of pdiethylaminobenzalde diphenylhydrazone doped N,N'-diphenyl-N,N'-bis(3-methylphenyl) 1,1;-biphenyl-4,4'-diamine : polycarbonate (40:60 wt:wt) in the charge transport layer are shown in FIG. 1. The thicknesses of the CTL on the drums were from 21 to 22 micrometers and their high field photosensitivities were all comparable. The $(dV/dX)_{x=0}$ for the four different devices were similar at about 250 V/ergs/cm$^2$, and the $E_{0.1}$ and $E_{0.2}$ were similar at about 0.2 and 0.4 ergs/cm$^2$, respectively. The $V_{low}$, however, was raised from ~40–220 volts with respect to increasing concentrations of p-diethylaminobenzalde diphenylhydrazone. Five thousand cycles tests at 20° C., 50 percent RH, were also measured for these drums and the results are displayed in FIG. 2. No apparent cycle-ups were observed, i.e., no increase of residual was observed, for these measurements. Excellent cyclic stability was also observed for all four photoreceptors. These results indicate that adding certain shallow trap dopants to a charge transport layer can vary $V_{low}$ while still maintaining initial photosensitivity and without major modifications to charge transport layer formulations and coating conditions.

EXAMPLE II

The procedures of Example I were repeated except that chlorogallium phthalocyanine particles and VMCH (available from Union Carbide) were substituted for the Type V hydroxy gallium phthalocyanine particles and VAGF, respectively. The initial and low exposure photosensitivities, $(dV/dX)_{x=0}$, $E_{0.1}$, and $E_{0.2}$, for the four different devices were similar at about 180 V/ergs/cm$^2$, 0.30 and 0.58 ergs/cm$^2$, respectively, and $V_{Low}$ of the PIDC curves were raised from about 40 to 190, 280, and 340 volts with respect to increasing concentrations of p-diethylaminobenzalde diphenylhydrazone. Five thousand cycles tests at 20° C./, 50 percent RH, were also measured for these drums and no apparent cycle-ups were observed, i.e., no increase of $V_{Residual}$ was observed, for these measurements. Excellent cyclic stability was also observed for all four photoreceptors. These results indicate that adding certain shallow trap dopants to a charge transport layer can vary $V_{low}$ while still maintaining initial photosensitivity and without major modifications to charge transport layer formulations and coating conditions.

EXAMPLE III

The $V_{Low}$ can also be raised without significantly altering the initial photosensitivity by replacing the Type V hydroxy gallium phthalocyanine particles with trigonal selenium particles.

EXAMPLE IV

The $V_{Low}$ can also be raised without significantly altering the initial photosensitivity by replacing the Type V hydroxy gallium phthalocyanine particles with benzimidazole perylene particles.

EXAMPLE V

The procedures of Example I can be repeated except that a mixture of tri-ptolylamine and 1-1-bis(di-4-tolylaminophenyl)cyclohexane at 1:1 weight ratio can be substituted for the N,N'-diphenyl-N,N'-bis(3-methylphenyl)-1,1;-biphenyl-4,4'-diamine hole transport host and N,N',N",N'"-tetrakis(4-methoxyphenyl)-(1,1'-biphenyl)-4,4'-diamine 0.15 volt shallow trap dopant can be substituted for the p-diethylaminobenzalde diphenylhydrazone shallow trap dopant. The concentrations of the substituted shallow trap dopant can be 0, 3, 6, and 10 weight percent based on the weight of the charge transport host. It is expected that the $V_{Low}$ will also be raised without significantly altering the initial photosensitivity with respect to increasing concentrations of the shallow trap dopant.

EXAMPLE VI

The procedures of Example V can be repeated except that N,N'-diphenyl-N,N'bis(3-methoxylphenyl)-1,1-biphenyl-4,4'-diamine 0.3 V shallow trap dopant was substituted for the N,N'-diphenyl-N,N'-bis(3-methylphenyl)-1,1;-biphenyl-4,4'-diamine shallow trap dopant. The concentrations of the substituted shallow trap dopant can be 0, 1, 3, and 6 weight percent based on the weight of the charge transport host. The $V_{Low}$ is also expected to be raised without significantly altering the initial photosensitivity with respect to increasing concentrations of the shallow trap dopant.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. An electrophotographic imaging member comprising a substrate, a charge generating layer, and a charge transport layer comprising a hole transport host material, a trace amount of a shallow trap dopant having a shallow trap electrochemical oxidation potential between about 0.02 volt and about 1.5 volts lower than that of the hole transport host, and a film forming binder.

2. An electrophotographic imaging member according to claim 1 wherein the trace amount of a shallow trap dopant is between about 0.01 percent and about 10 percent by weight, based on total weight of the hole transport host used in the charge transport layer.

3. An electrophotographic imaging member according to claim 1 wherein the electrochemical oxidation potential of the shallow trap dopant is between about 0.8 volt and about 1.5 volts lower than that of the hole transport host material and the charge transport layer contains between about 0.1 percent and about 4 percent by weight of the shallow trap dopant based on the total weight of the charge transport layer.

4. An electrophotographic imaging member according to claim 1 wherein the electrochemical oxidation potential of the shallow trap dopant is between about 0.02 volt and about 0.8 volt lower than that of the hole transport host material and the hole transport layer contains between about 0.5 percent and about 10 percent by weight of the shallow trap dopant based on the total weight of the charge transport layer.

5. An electrophotographic imaging member according to claim 1 wherein the shallow trap dopant is p-diethylaminobenzalde diphenylhydrazone.

6. An electrophotographic imaging member according to claim 1 wherein the shallow trap dopant is N,N',N",N'"-tetrakis(4-methylphenyl)-(1,1'-biphenyl)-4,4'-diamine.

7. An electrophotographic imaging member according to claim 1 wherein the shallow trap dopant is N,N',N",N'"-tetrakis(4-methoxyphenyl)-(1,1'-biphenyl)-4,4'-diamine.

8. An electrophotographic imaging member according to claim 1 wherein the shallow trap dopant is N,N',bis-(4-methylphenyl)-N,N"-bis(4-ethylphenyl)-1,1'-3,3'-dimethylbiphenyl)-4,4'-diamine.

9. A process for fabricating electrophotographic imaging members comprising providing a member comprising a substrate, a charge generating layer, and forming a charge transport layer on the charge generating layer, the charge transport layer comprising a hole transport host material, a trace amount of a shallow trap dopant having a shallow trap electrochemical oxidation potential between about 0.02 volt and about 1.5 volts lower than that of the hole transport host, and a film forming binder.

10. A process according to claim 9 wherein the trace amount of a shallow trap dopant is between about 0.01 percent and about 10 percent by weight, based on total weight of the hole transport material used in the charge transport layer.

11. A process according to claim 9 wherein the electrochemical oxidation potential of the shallow trap dopant is between about 0.8 volt and about 1.5 volts lower than that of the hole transport material and the charge transport layer contains between about 0.1 percent and about 4 percent by weight of the shallow trap dopant based on the total weight of the charge transport layer.

12. A process according to claim 8 wherein the electrochemical oxidation potential of the shallow trap dopant is between about 0.02 volt and about 0.8 volt lower than that of the hole transport material and the hole transport layer contains between about 0.5 percent and about 10 percent by weight of the shallow trap dopant based on the total weight of the charge transport layer.

13. A process according to claim 8 wherein the hole transport host material comprises at least two charge transport molecules.

14. A process according to claim 13 wherein the hole transport host material comprises a mixture of tri-p-tolylamine and 1-1-bis(di-4-tolylaminophenyl)cyclohexane.

15. A process according to claim 8 wherein the hole transport host material is a polymer.

16. A process according to claim 8 wherein the hole transport host material comprises a polymer and this hole transport host material is also the film forming binder.

17. A process according to claim 8 wherein the shallow trap dopant is a polymer.

* * * * *